US007484765B2

(12) United States Patent
Harper

(10) Patent No.: US 7,484,765 B2
(45) Date of Patent: Feb. 3, 2009

(54) RETRACTABLE SNOWBOARD SUPPORT APPARATUS FOR USE IN LIFT ASSIST TRANSPORT

(76) Inventor: David John Harper, P.O. Box 21339, Eugene, OR (US) 97402

( * ) Notice: Subject to any disclaimer, the term of this patent is extended or adjusted under 35 U.S.C. 154(b) by 0 days.

(21) Appl. No.: 11/407,879

(22) Filed: Apr. 19, 2006

(65) Prior Publication Data

US 2007/0152418 A1 Jul. 5, 2007

Related U.S. Application Data

(60) Provisional application No. 60/672,624, filed on Apr. 19, 2005.

(51) Int. Cl.
*A63C 11/00* (2006.01)

(52) U.S. Cl. ..... 280/809; 280/814; 280/816; 280/14.27; 280/14.21

(58) Field of Classification Search ..... 280/14.21, 280/14.22, 14.27, 14.28, 603, 606, 809, 814, 280/816; 297/423.39, 423.4
See application file for complete search history.

(56) References Cited

U.S. PATENT DOCUMENTS

| | | | | |
|---|---|---|---|---|
| 4,363,495 | A * | 12/1982 | Henson | 280/14.28 |
| 6,217,073 | B1 * | 4/2001 | Hoffman | 280/823 |
| 6,929,267 | B2 * | 8/2005 | Sullivan et al. | 280/14.28 |
| 2005/0280223 | A1 * | 12/2005 | Su | 280/14.27 |

FOREIGN PATENT DOCUMENTS

WO WO 9929377 A1 * 6/1999

* cited by examiner

*Primary Examiner*—Christopher P Ellis
*Assistant Examiner*—Katy Meyer
(74) *Attorney, Agent, or Firm*—Steven J. Adamson

(57) ABSTRACT

A snowboard support device for use in lift assist transport. The device may have a base, an extension shaft and a handle member or the like. In one embodiment, the handle serves as a housing to cover the extension shaft in its closed position and provides an engagement surface for non-fixed, gravity-based engagement of a chair lift seat.

21 Claims, 10 Drawing Sheets

RETRACTABLE SNOWBOARD SUPPORT APPARATUS FOR USE IN LIFT ASSIST TRANSPORT

CROSS REFERENCE TO RELATED APPLICATIONS

This application claims the benefit of earlier filed U.S. provisional patent application No. 60/672,624, filed Apr. 19, 2005, and having the same title and inventor as above.

FIELD OF THE INVENTION

The present invention relates to snowboards and like devices and more specifically to a compactable or retractable mechanism for bearing weight from the board during a chair lift ride.

BACKGROUND OF THE INVENTION

Snowboarding is a relatively new and growing winter recreational activity. The experience is somewhat similar to a skateboarding experience, though, among other differences, in snowboarding a user's feet are fixedly attached to a board during use. After a run, a user releases one foot, normally the rear foot, and pushes with that foot to maneuver through chair lift lines and onto a chair lift. During the chair lift ride, the board dangles unbalanced and uncomfortably from the permanently attached foot. Upon exiting the chair lift, a user reattaches his or her free "foot" before descending a run.

A need exists to alleviate the awkward and uncomfortable situation of having a board dangle from a user's foot during a chair lift ride. Several prior art devices are known that address this problem. They include the devices disclosed in U.S. Pat. No.: 6,349,968 issued to Owen; U.S. Pat. No. 5,951,048 issued to Slaughter; U.S. Pat. No. 5,564,729 issued to Gomez; U.S. Pat. No. 5,090,722 issued to Ritchie; U.S. Pat. No. 5,356,159 issued to Butterfield; and U.S. Pat. No. 6,247,728 issued to Verville.

U.S. Pat. No. 6,349,968 to Owen teaches a cord with a releasable carbiner type clamp. This device is disadvantageous for several reasons including that if there is any problem with release, due to operator error or mechanical failure, the user is unreleasably coupled to the moving chair lift, potentially resulting in serious injury at unloading and/or stoppage of the lift apparatus. Also the extended cord does not lend itself to ready and secure stowage.

Various other know devices, such as those disclosed in U.S. Pat. No.: 5,090,722 to Ritchie, U.S. Pat. No. 5,356,159 to Butterfield and U.S. Pat. No. 6,247,728 to Verville, illustrate positive engagement devices provided on boards, bindings or boots where the "free" foot is temporarily coupled to the board through the positive engagement device. These devices tend to be disadvantageous in that they may be difficult to use particularly in winter conditions where parts may frequently be clogged with snow or ice and cold fingers may loose the dexterity required for operation. Also, device reliability is questionable due in part to fouling or inherent design limitations in the devices or the object to which they attach, etc. Furthermore, while they may balance weight more evenly over two feet, the weight of the board and boots, etc., is wholly supported by the legs not permitting leg muscles to rest more fully before the next run.

A need thus exists for a mechanism for better supporting a snowboard or like device during chair lift or related transport. This need may include the need for a device that more evenly balances weight, can mount to a lift chair or other structure in a supportive, secure manner which is readily and inherently separable from the chair or structure, is readily and securely stowable when not in use and/or directly supports board weight permitting legs to rest, among other needs.

Accordingly, it is an object of the present invention to provide these and related features or functionality. The attainment of these and related features and advantages should be more readily apparent to those skilled in the art, after review of the following more detailed description of the invention taken together with the drawings.

BRIEF DESCRIPTION OF THE DRAWINGS

FIG. 2 illustrates the device of FIG. 1 in a stowage position, while

FIGS. 4 and 5 perspective views the device of FIG. 1 at different levels of extension, while

DETAILED DESCRIPTION

Figure 1:
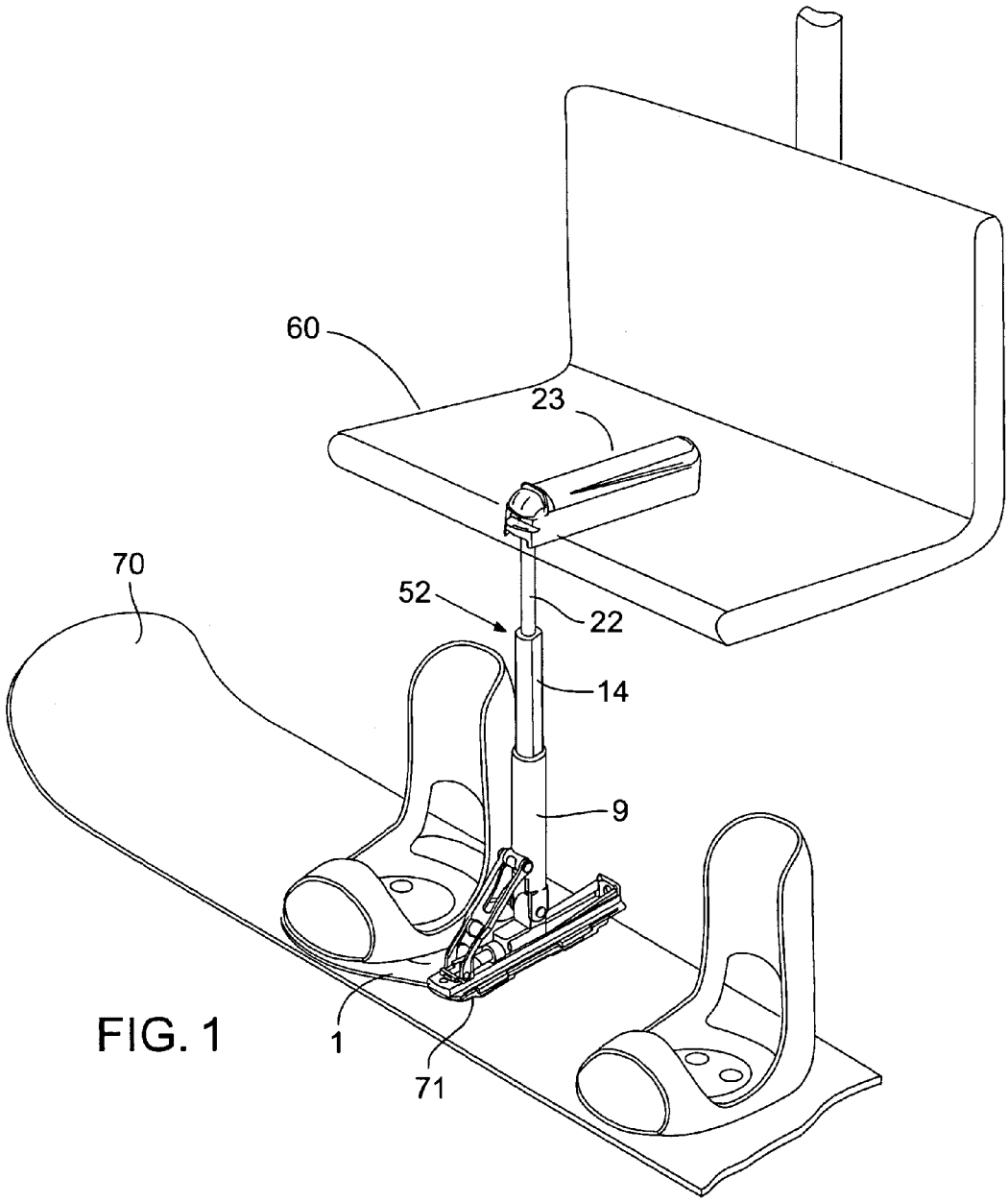
FIG. 1 is a perspective view of one embodiment of a snowboard support device in accordance with the present invention is shown.

Referring to FIG. 1, a perspective view of a snowboard support device 50 in accordance with the present invention is shown. FIG. 1 illustrates device 50 in an extended position with handle/housing ("handle") 23 resting on a chair lift seat 60. Device 50 is preferably mounted to a snowboard 70 or other device through an extension 71 of binding plate 1 (shown in other figures) or other suitable means. Extension shaft 52 may be pivotally coupled to base 4 through a shuttle 6 movably mounted on shuttle shaft 5. Extension shaft 52 may have a telescoping configuration and include a lower, middle and upper section 9,14,22, respectively. Handle 23 may be pivotally coupled to upper section 22 and configured to not extend substantially past 90 degrees.

Figure 2:
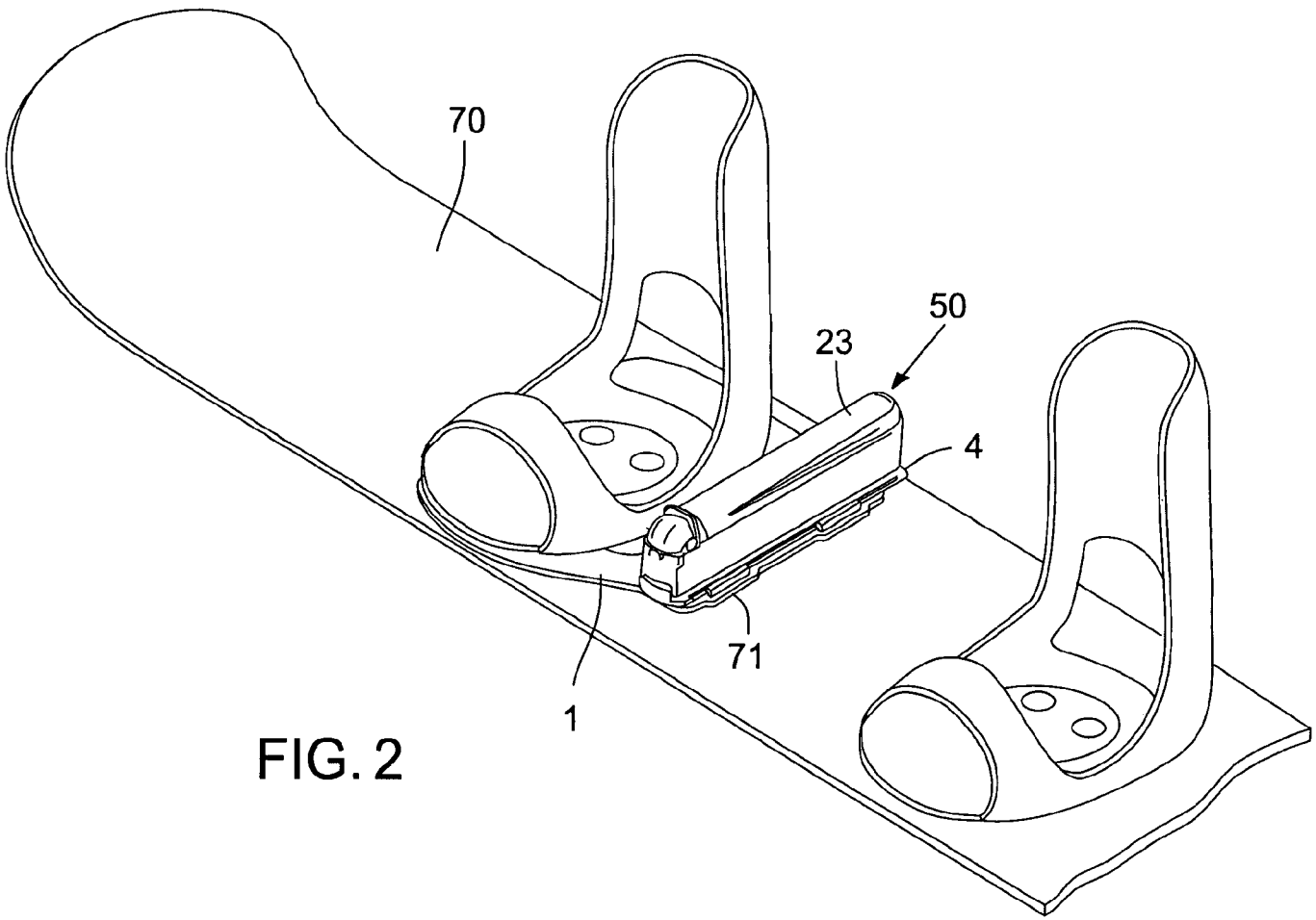
Figure 3:
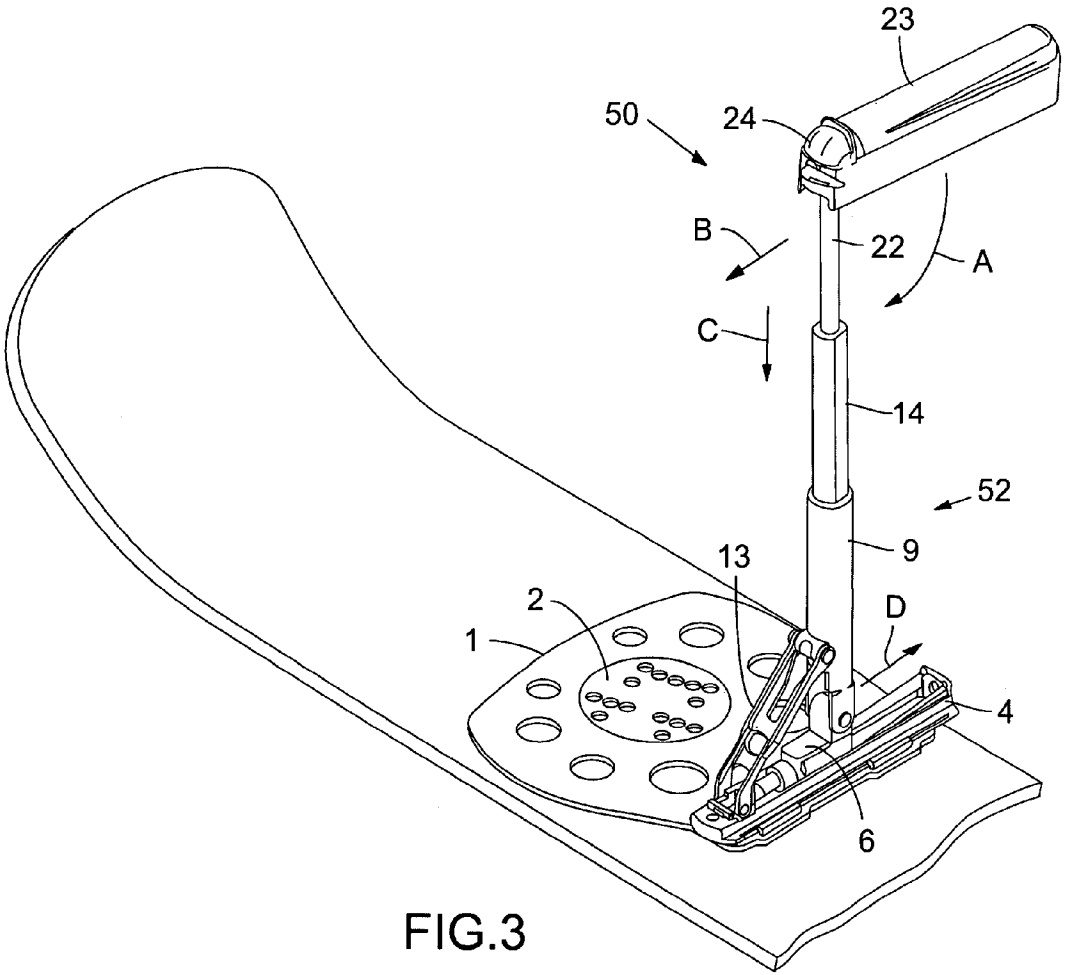
FIG. 3 illustrates the device in an extended position.

FIG. 2 illustrates device 50 in a stowage position compactly contracted within handle 23. FIG. 3 illustrates device 50 in an extended position. The base 4, shuttle 6 and extension shaft 52 are visible in this view. The binding plate 1 and disk 2, pivot arm 13, release latch 24 and other features are also shown.

Device 50 is preferably biased towards the extended position. To contract it, a user applies a downward force in the direction of arrow C to compress the shaft and then in the direction of arrow B to move the orientation of shaft 52 toward horizontal. Movement in the direction of arrow B causes the lower section of shaft 52 to pivot about pivot arm 13 and move via movement of shuttle 6 on shuttle shaft 5 (see FIG. 4) in the direction of arrow D. Handle 23 is moved generally downward in the direction of arrow A until it mounts on and "clicks" into base 4. To extend the device, latch release mechanism 24 is actuated by a user which releases handle 23 from base 4 and permits a user to extend the handle to the extended position for resting on a chair lift seat as shown in FIG. 1 (and the handle is preferably biased towards this extended position). It should be recognized that by merely resting on the chair lift seat (as opposed to positively attaching such as with a clip or carbiner), the present invention is much less likely to become inadvertently attached to the chair lift.

Figure 4:
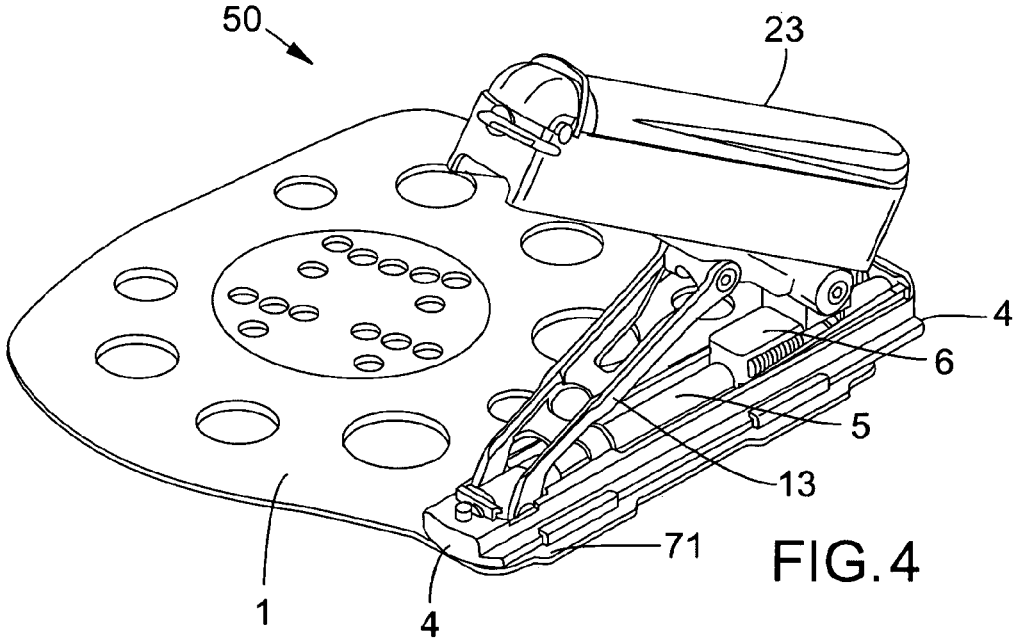
Figure 5:
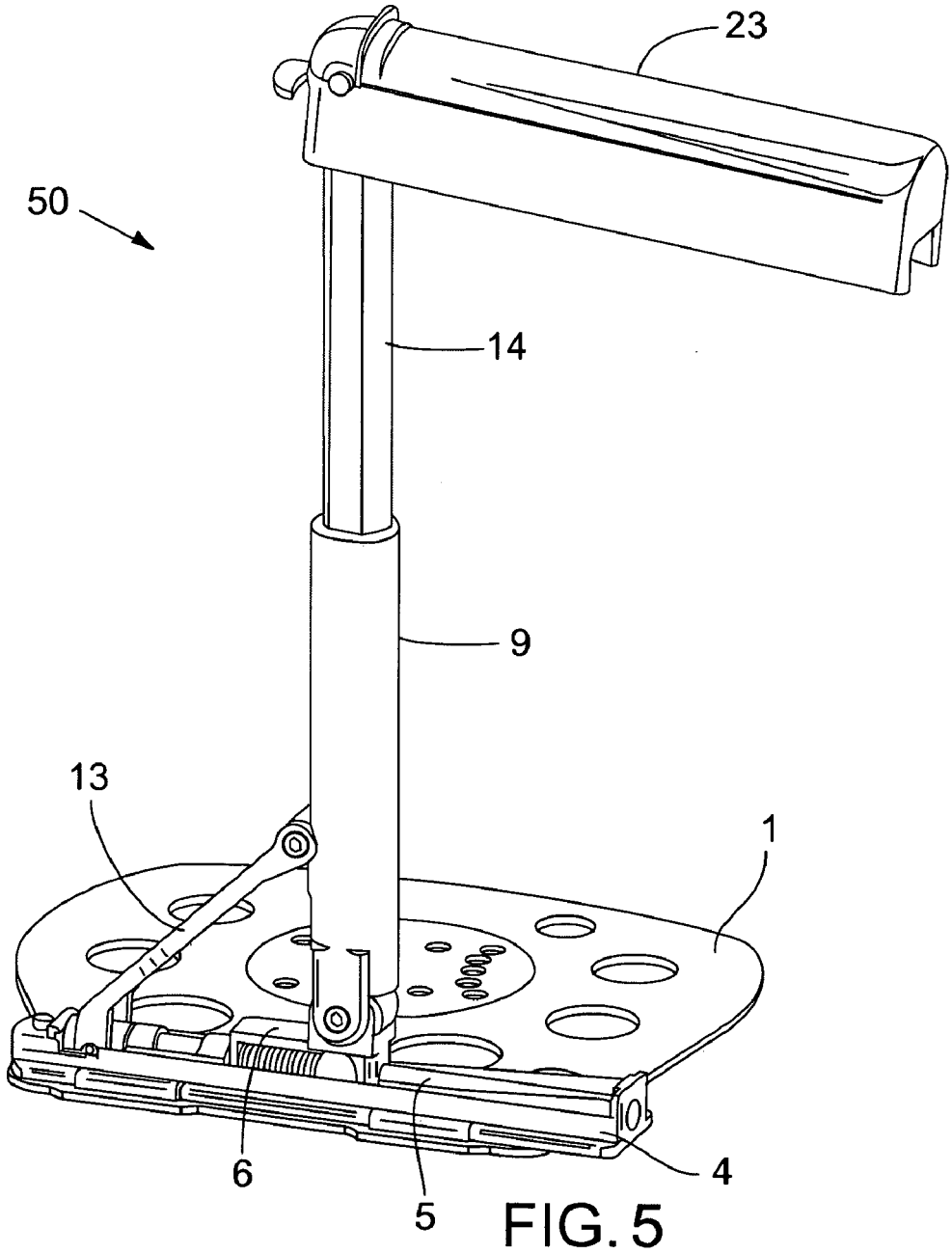
Figure 6:
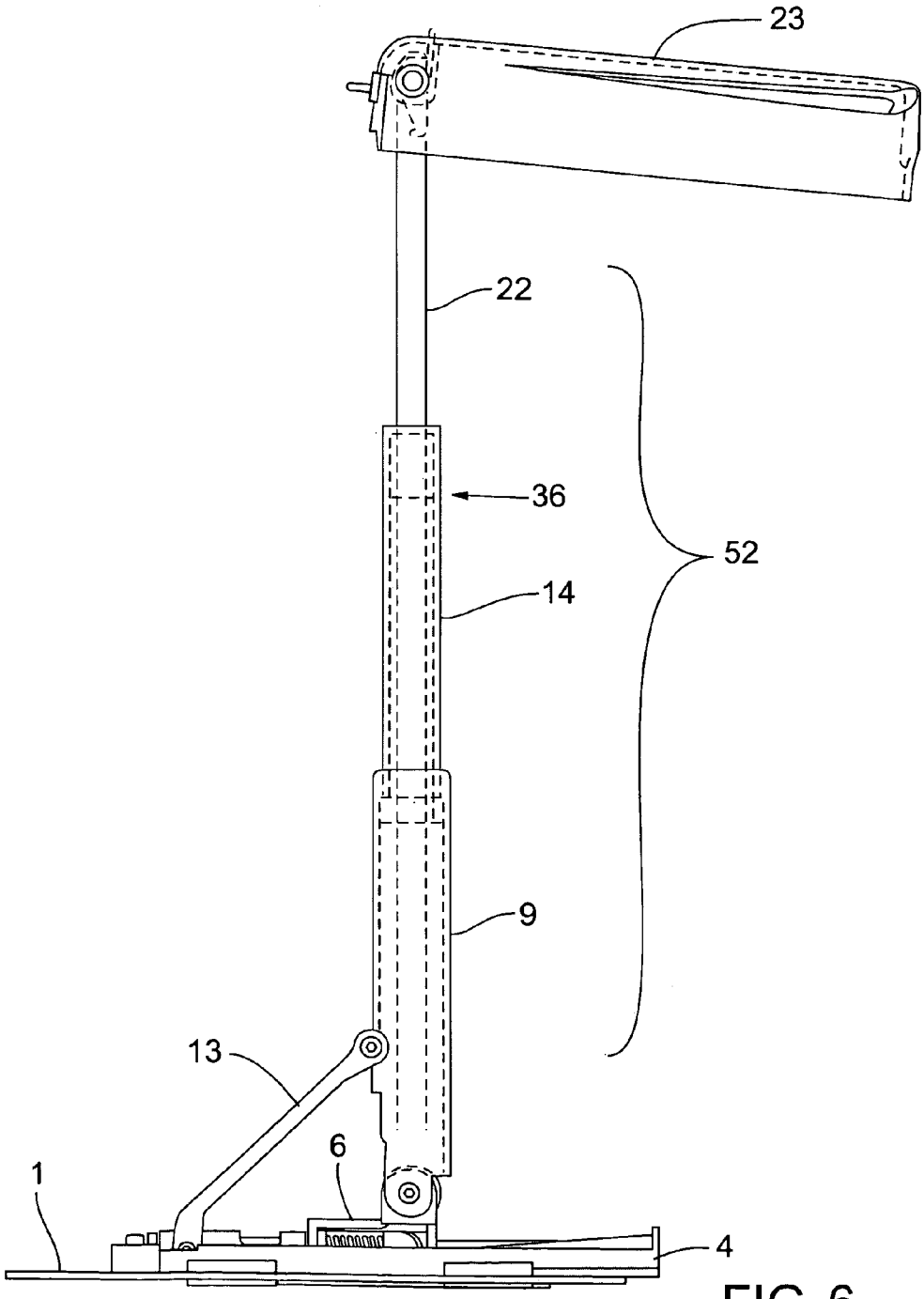
FIG. 6 is side elevation view of the device in the extended position.
Figure 7:
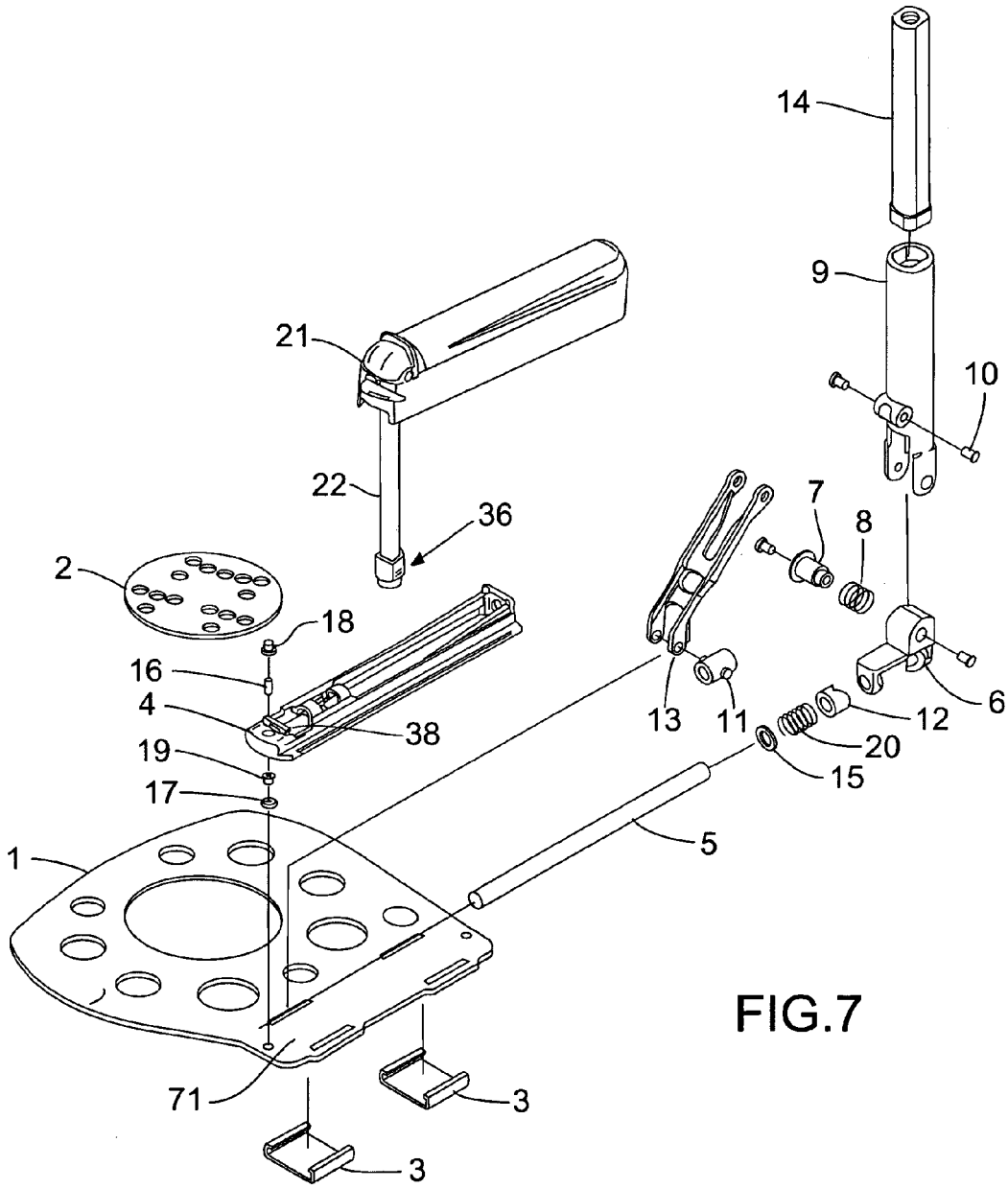
FIGS. 7-8 are exploded perspective views of the device of FIG. 1 and the top extension shaft of that device, respectively.
Figure 8:
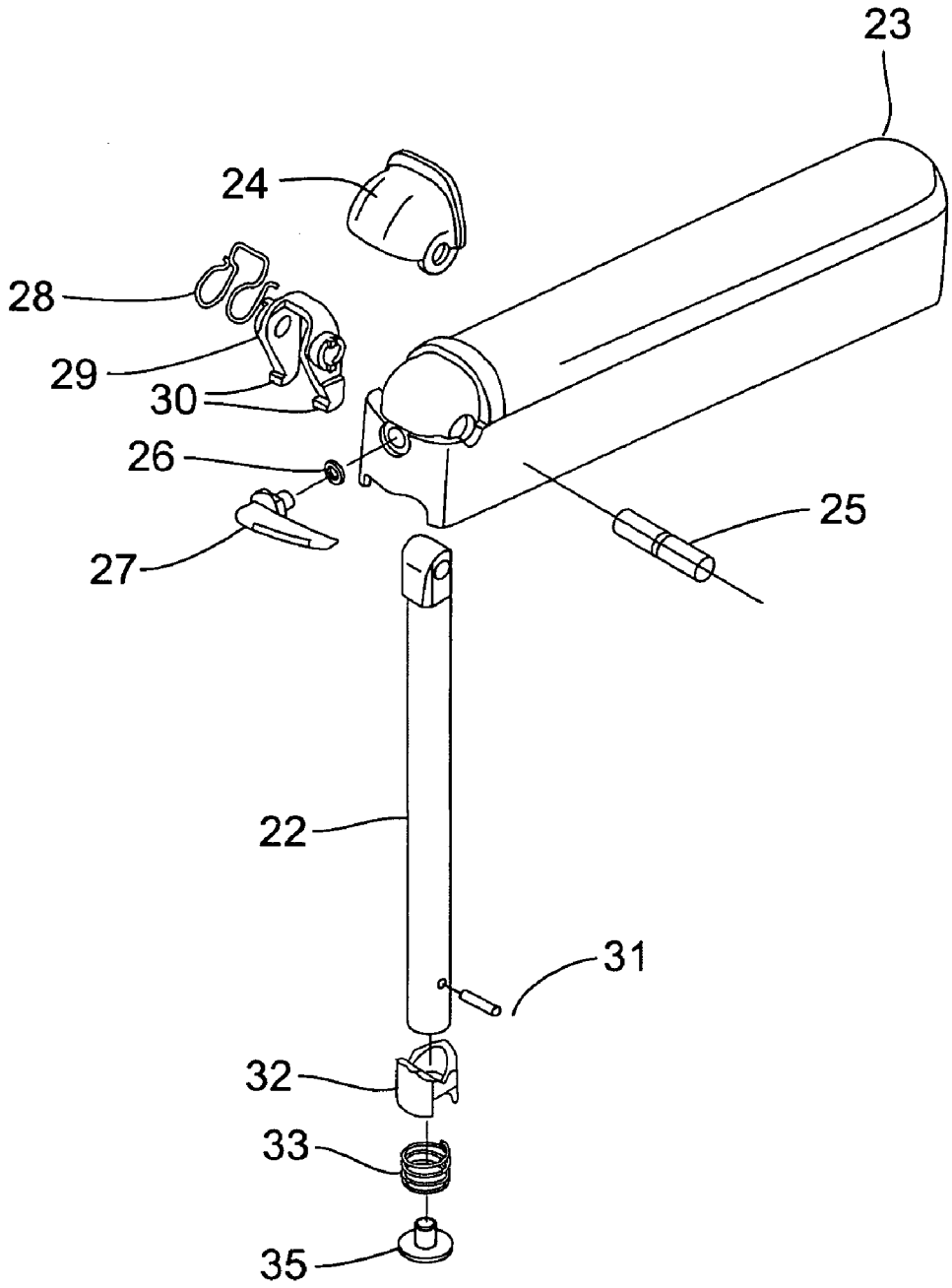

FIGS. 4-6 are three perspective views illustrating embodiments of device 50 at three different levels of extension. FIGS. 7-8 are two exploded perspective views that illustrate the various components of the embodiments of device 50 of FIGS. 4-6.

The mounting of a binding plate 1 to a board is known. For device 50, an exterior region 71 is provided with binding plate 1 and clips 3 are used to mount base 4 to the binding plate. Shaft 5 is provided within the structure of base 4 and shuttle 6 is preferably configured for movement along shaft 5. Spring 20 biases housing 6 away from a contracted position causing shaft 52 to rise up in response to a release of latch mechanism 24 (described below). Axle 7 facilitates pivotal coupling of shaft 52 to shuttle 6.

Pivot arm 13 is coupled to a pivot member 11 into which shuttle shaft 5 is inserted. These items are held in place by firmly secured base 4. Pivot arm 13 is coupled to lower shaft section 9.

Extension shaft sections 9,14,22 telescope within each other. See, for example, FIG. 6. A spring tempered anchor 36 is preferably provided in top section 22 to absorb shocks and some lateral movement.

FIG. 8 illustrates details of the handle 23 and top shaft section 22. Latch actuator 24 is movably coupled through pin 25 to handle 23 and further to internal latch 29. Cam spring 28 biased latch 29 towards engagement. When handle 23 is pressed onto base 4 the teeth 30 of latch 29 hook underneath ledge 38 of base 4 (see FIG. 7). To release the handle from the base, latch actuator 24 is pushed forward causing the internal latch 29 to rotate such that teeth 30 disengage ledge 38. Lock knob 27 in the straight up position blocks movement of latch 24.

Anchor 36 may include an axial screw 35 that mounts cam 32 and spring 33 to top shaft section 22 adjacent pin 31. The spring and cam serve to center top shaft section 22 and provide some flexibility and shock absorption.

Figure 9:
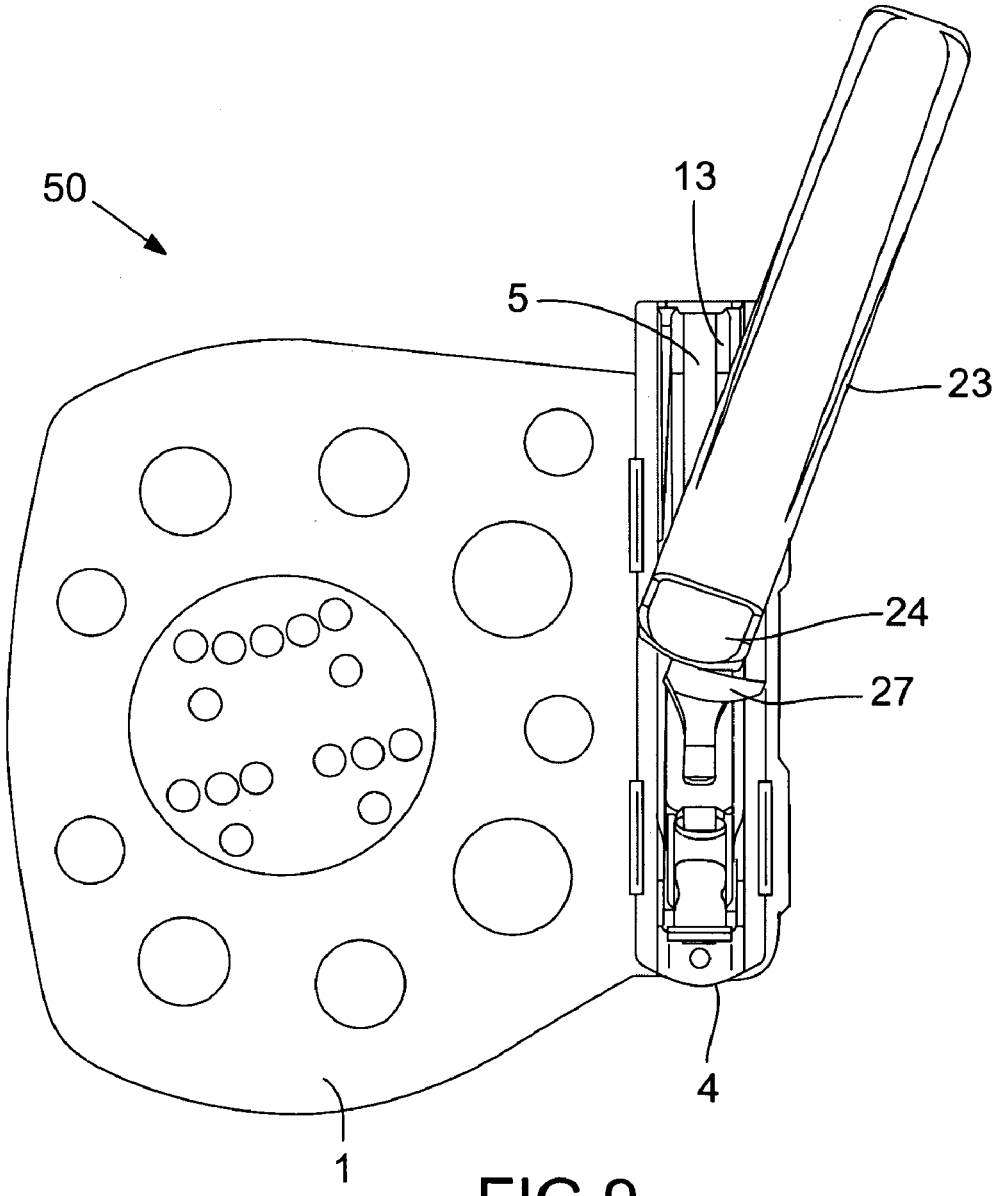
FIGS. 9-10 are a top plan view and a side elevation view illustrating cam-based positioning of the handle and shaft, respectively, of the device of FIG. 1.
Figure 10:
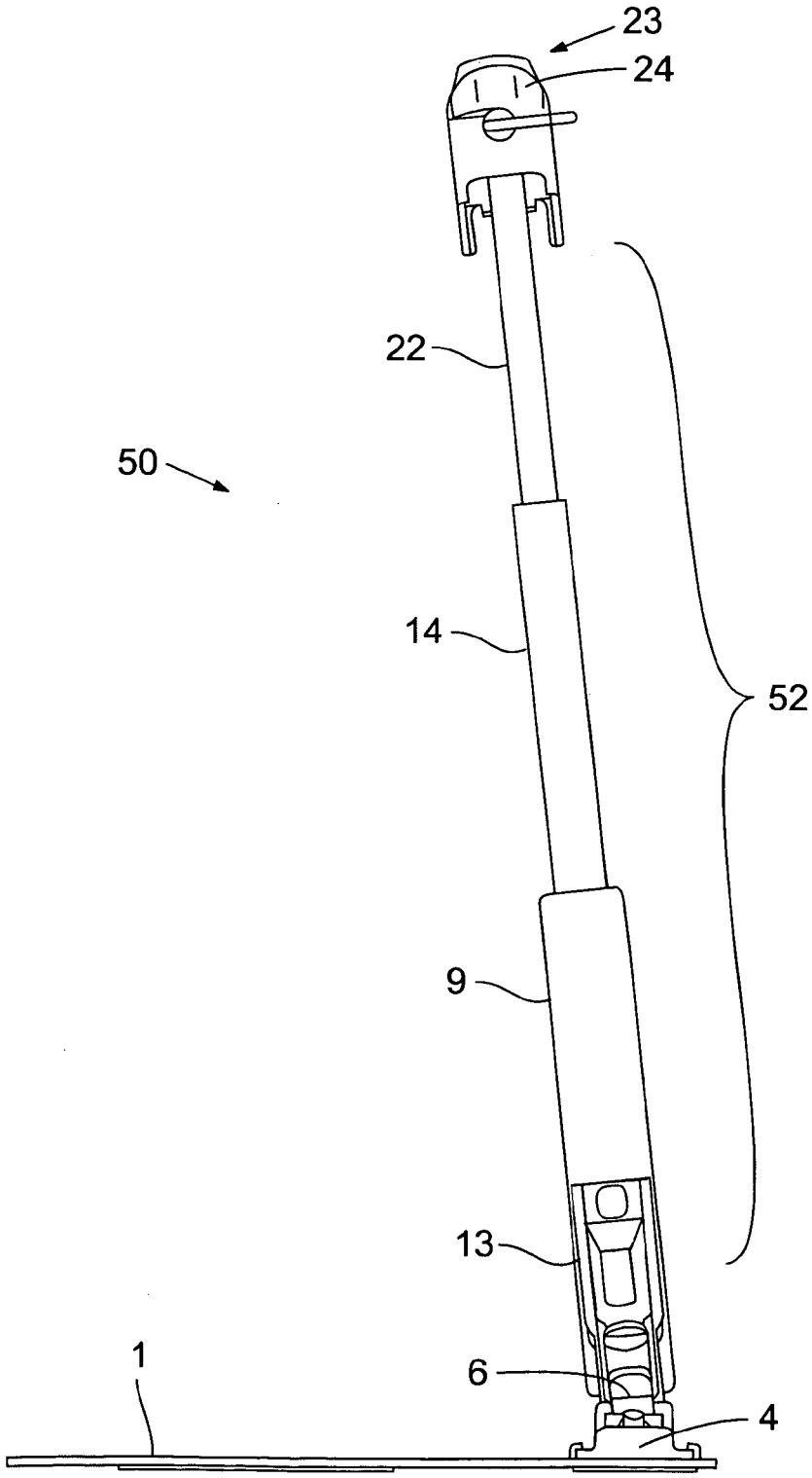

FIGS. 9 and 10 illustrate features of the functionality of device 50. The bottom two shaft sections are preferably configured such that they do not turn (though they may be configured otherwise without departing from the invention). The top shaft section 22 is preferably coupled through a cam arrangement that permits turning, but recenters in the absence of a turning force as discussed above with reference to FIG. 8, and shown in FIG. 9. FIG. 10 illustrates that the extension shaft may be provided with shuttle 6 and cam spring 20 (FIG. 7) such that the shuttle is biased towards vertical with a certain amount of play.

Components may be made of metal, plastic or other suitable materials.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A snowboard support device for use in lift chair assisted transport, comprising:

a base;

an extension shaft coupled to the base and movable between an extended position and a non-extended position; and an engagement member having a bottom engagement surface configured for non-fixed, gravity-based engagement of a chair lift seat;

wherein the engagement member is coupled to the extension shaft such that in the extended position the engagement surface is positionable for placement onto a chair lift seat unimpeded by the shaft; and wherein the engagement member and the extension shaft are configured such that the engagement member substantially houses the extension shaft in the non-extended position.

2. The device of claim 1, wherein the extension shaft and engagement member are configured such that in the extended position the engagement member is movable, relative to the longitudinal axis of the extension shaft, in at least one of a substantially horizontal plane and a substantially vertical plane.

3. The device of claim 1, wherein the engagement member includes a housing configured to provide a handle.

4. The device of claim 2, wherein the engagement member is movable, relative to the longitudinal axis of the extension shaft, in both a substantially horizontal plane and a substantially vertical plane.

5. The device of claim 1, wherein the extension shaft is biased towards the extended position.

6. The device of claim 5, wherein the engagement member includes a housing that covers the extension shaft in the non-extended position and is coupled through a releasable latch to the base such that release of the latch permits the extension shaft to extend via the bias towards the extended position.

7. The device of claim 1, wherein is the extension shaft is comprised of a plurality of telescoping shaft segments.

8. The device of claim 7, further comprising a movable support member to which the telescoping shaft segments are attached, the support member moving along a track as the shaft sections move pivotally downward to a closed position.

9. The device, of claim 1, wherein the extension shaft includes a cam device that biases the engagement member into a given alignment with the extension shaft.

10. A snowboard support device for use in lift chair assisted transport, comprising:

a base;

an extension shaft coupled to the base and movable between an extended position and a non-extended position; and an engagement member movably coupled to the extension shaft and having a bottom engagement surface configured for non-fixed, gravity-based engagement of a chair lift seat;

wherein the engagement member is coupled to the extension shaft such that in the extended position the engagement surface is positionable for placement onto a chair lift seat unimpeded by the shaft;

wherein the extension shaft and engagement member are configured such that in the extended position the engagement member is movable, relative to the longitudinal axis of the extension shaft, in at least one of a substantially horizontal plane and a substantially vertical plane; and wherein the extension shaft includes a cam device that biases the engagement member into a given alignment with the extension shaft.

11. The device of claim 10, wherein the engagement member is configured to form a control handle, and the control handle substantially covers the extension shaft in the non-extended position.

12. The device of claim 10, wherein the extension shaft is biased towards the extended position.

13. The device of claim 12, wherein the housing is coupled through a releasable latch to the base such that release of the latch permits the extension shaft to extend under bias towards the extended position.

14. The device of claim 10, wherein is the extension shaft is comprised of a plurality of telescoping shaft segments.

15. A snowboard support device for use in lift chair assisted transport, comprising:

a base;

an extension shaft coupled to the base and movable between an extended position and a non-extended position; and an engagement member having a bottom engagement surface configured for non-fixed, gravity-based engagement of a chair lift seat;

wherein the engagement member is coupled to the extension shaft such that in the extended position the engagement surface is positionable for placement onto a chair lift seat unimpeded by the shaft;

wherein the extension shaft is biased towards the extended position; and wherein the engagement member includes a housing that covers the extension shaft in the non-extended position and is coupled through a releasable latch to the base such that release of the latch permits the extension shaft to extend via the bias towards the extended position.

16. The device of claim 15, wherein the extension shaft and engagement member are configured such that in the extended position the engagement member is movable, relative to the longitudinal axis of the extension shaft, in at least one of a substantially horizontal, plane and a substantially vertical plane.

17. The device of claim 16, wherein the extension shaft includes a cam device that biases the engagement member into a given alignment with the extension shaft.

18. The device of claim 15, wherein is the extension shaft is comprised of a plurality of telescoping shaft segments.

19. The device of claim 15, further comprising a movable support member to which the telescoping shaft segments are attached, the support member moving along a track as the shaft sections move pivotally downward to a closed position.

20. The device of claim 15, wherein the extension shaft includes a cam device that biases the engagement member into a given alignment with the extension shaft.

21. A snowboard support device for use in lift chair assisted transport, comprising:

a base;

an extension shaft coupled to the base and movable between an extended position and a non-extended position; and a control handle having a bottom engagement surface configured for non-fixed, gravity-based engagement of a chair lift seat;

wherein the control handle is coupled to the extension shaft such that in the extended position the engagement surface is positionable for placement onto a chair lift seat unimpeded by the shaft; and wherein the control handle is movable relative to the longitudinal axis of the extension shaft;

wherein the control handle is configured to substantially house the extension shaft in the non-extended position.

* * * * *